US005979007A

United States Patent [19]

Soon

[11] Patent Number: 5,979,007

[45] Date of Patent: Nov. 9, 1999

[54] TOWEL MITT FOR WASHING

[76] Inventor: Min Tet Soon, P.O. Box A-499, 89357 Inanam, Malaysia

[21] Appl. No.: 08/992,721

[22] Filed: Dec. 17, 1997

[51] Int. Cl.[6] ..... A47L 13/18

[52] U.S. Cl. ..... 15/227; 2/159

[58] Field of Search ..... 15/227; 2/158, 2/159

[56] References Cited

U.S. PATENT DOCUMENTS

| | | | |
|---|---|---|---|
| D. 365,896 | 1/1996 | Zuege | D32/40 |
| 981,192 | 1/1911 | Hollingshead | 2/158 |
| 1,141,580 | 6/1915 | Reddick | 15/227 |
| 1,193,529 | 8/1916 | Ellis | 15/227 |
| 1,254,913 | 1/1918 | Kitamura | 15/227 |
| 1,478,914 | 12/1923 | Ritzenthaler | 15/227 |
| 1,564,219 | 12/1925 | Drueding | 15/227 |
| 1,666,096 | 4/1928 | Jackson | 15/227 |
| 1,882,179 | 10/1932 | Daly | 15/227 |
| 1,882,588 | 10/1932 | Heath | 15/227 |
| 2,239,919 | 4/1941 | Lindfelt | 15/227 |
| 2,391,263 | 12/1945 | Morton | 2/158 |
| 4,893,372 | 1/1990 | Wenzel | 15/227 |
| 4,953,250 | 9/1990 | Brown | 15/104.94 |
| 4,980,943 | 1/1991 | Barber | 15/227 |
| 5,525,393 | 6/1996 | Raab | 428/89 |

*Primary Examiner*—Mark Spisich
*Assistant Examiner*—Theresa T. Snider
*Attorney, Agent, or Firm*—Richard L. Miller, P.E.

[57] ABSTRACT

A towel mitt for washing that includes a first layer of material and a second layer of material juxtaposed on the second layer of material and forms therewith a hand receiving pocket for receiving a hand of a user. The first and second layers of material have pile outer faces for delicate washing and abrasive inner faces for more abrasive cleaning and for increasing friction between the hand of the user and the towel mitt so as to prevent unintentional dropping of the towel mitt. The hand receiving pocket is symmetrical relative to the longitudinal centerline of the towel mitt so as to allow the towel mitt to be used on either hand without discomfort, and is defined by stitching that is inward of the edges of the first and second layers of material so as to form flaps that when flipped above expose the abrasive inner faces of the first and second layers of material for utilization when more abrasive cleaning is required.

10 Claims, 1 Drawing Sheet

TOWEL MITT FOR WASHING

BACKGROUND OF THE INVENTION

1. Field of the Invention

The present invention relates to a mitt. More particularly, the present invention relates to a towel mitt for washing.

2. Description of the Prior Art

Numerous innovations for cleaning mitts have been provided in the prior art that will be described. Even though these innovations may be suitable for the specific individual purposes to which they address, however, they differ from the present invention.

FOR EXAMPLE, U.S. Pat. No. Des. 365,896 to Zuege teaches the ornamental design for the dusting glove.

ANOTHER EXAMPLE, U.S. Pat. No. 4,893,372 to Wenzel teaches a free-hand tubular towel that has at its upper end an elastic band for encircling and gripping a user's arm at a location above or slightly below the elbow and has an enlarged lower end portion that drapes loosely over the user's hand and can be reverse-folded over the upper end portion to uncover the hand. The lower end portion can be secured in retracted position over the tubular upper end portion of the towel by interengagement of coacting patches of a hook-and-pile fastener, one being located near the, upper end of the towel and the other being located near the lower end of the towel.

STILL ANOTHER EXAMPLE, U.S. Pat. No. 4,953,250 to Brown teaches a disposable washing glove which includes a felted base made of carded staple fibers mechanically interlocked, structured by use of special forked needles to create a high-pile fabric, having recesses therein. The fabric is coated on one side with a detergent material which also fills the recesses to permit a timed release of the detergent during use.

YET ANOTHER EXAMPLE, U.S. Pat. No. 4,980,943 to Barber teaches a cleaning glove which includes a glove base having a side to which there is attached a primary layer of a tufted blended yarn tufted to the glove base and one or more fibrous bristle portions or strips. The blended yarn is made by weaving together three or more individual yarns including one yarn made of acrylic fibers, wool fibers or polyester fibers.

FINALLY, STILL YET ANOTHER EXAMPLE, U.S. Pat. No. 5,525,393 to Raab teaches a method for the manufacture of a plush-type cleaning cloth from pile fabric in which a layer of thermoplastic pile fibers is anchored by fusing to a base structure of thermoplastic fibers at temperatures from 423 to 433 K (150 degrees–160 degrees C), pile fibers of different melting and shrinking temperature properties are used in a distribution over the entire surface, so that a first portion of the pile fibers shrinks at the fusing temperature and a second portion of the pile fibers does not shrink or shrinks less than the first portion. The first portion of the pile fibers comprises approximately 60% of the total amount of the pile fibers and provides increased scrubbing properties as a result of their crimped, harder structure.

It is apparent that numerous innovations for cleaning mitts have been provided in the prior art that are adapted to be used. Furthermore, even though these innovations may be suitable for the specific individual purposes to which they address, however, they would not be suitable for the purposes of the present invention as heretofore described.

SUMMARY OF THE INVENTION

ACCORDINGLY, AN OBJECT of the present invention is to provide a towel mitt for washing that avoids the disadvantages of the prior art.

ANOTHER OBJECT of the present invention is to provide a towel mitt for washing that is simple and inexpensive to manufacture.

STILL ANOTHER OBJECT of the present invention is to provide a towel mitt for washing that is simple to use.

BRIEFLY STATED, YET ANOTHER OBJECT of the present invention is to provide a towel mitt for washing that includes a first layer of material and a second layer of material juxtaposed on the second layer of material and forms therewith a hand receiving pocket for receiving a hand of a user. The first and second layers of material have pile outer faces for delicate washing and abrasive inner faces for more abrasive cleaning and for increasing friction between the hand of the user and the towel mitt so as to prevent unintentional dropping of the towel mitt. The hand receiving pocket is symmetrical relative to the longitudinal centerline of the towel mitt so as to allow the towel mitt to be used on either hand without discomfort, and is defined by stitching that is inward of the edges of the first and second layers of material so as to form flaps that when flipped above expose the abrasive inner faces of the first and second layers of material for utilization when more abrasive cleaning is required.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures on the drawing are briefly described as follows.

LIST OF REFERENCE NUMERALS UTILIZED IN THE DRAWING

Figure 1:
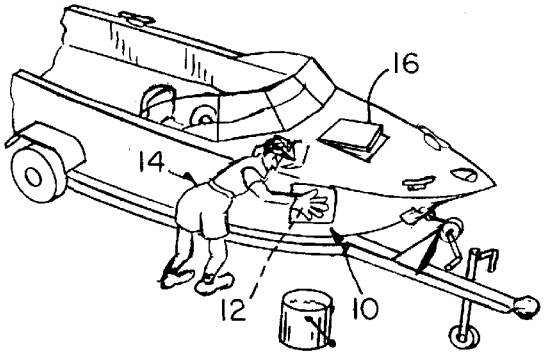
FIG. 1 is a diagrammatic perspective view of the present invention being utilized to wash a boat.

10 towel mitt for washing of the present invention
12 hand of user 14
14 user
16 boat
18 car
20 first layer of material
22 outer face of first layer of material 20
24 opposing inner face of first layer of material 20
26 second layer of material
28 outer face of second layer of material 26
30 opposing inner face of second layer of material 26
32 centerline
34 four common edges
36 specifically configured stitching
38 hand receiving pocket
40 five finger receiving pockets
42 flaps

DETAILED DESCRIPTION OF THE PREFERRED EMBODIMENT

Figure 2:
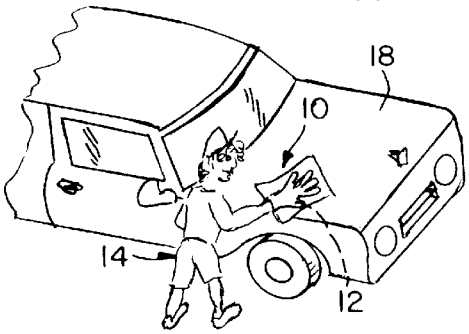
FIG. 2 is a diagrammatic perspective view of the present invention being utilized to wash a car.

Referring now to the figures in which like numerals indicate like parts, and particularly to FIGS. 1 and 2, the towel mitt for washing of the present invention is shown generally at 10 replaceably receiving a hand 12 of a user 14 and being used to wash a boat 16 and a car 18, respectively.

Figure 3:
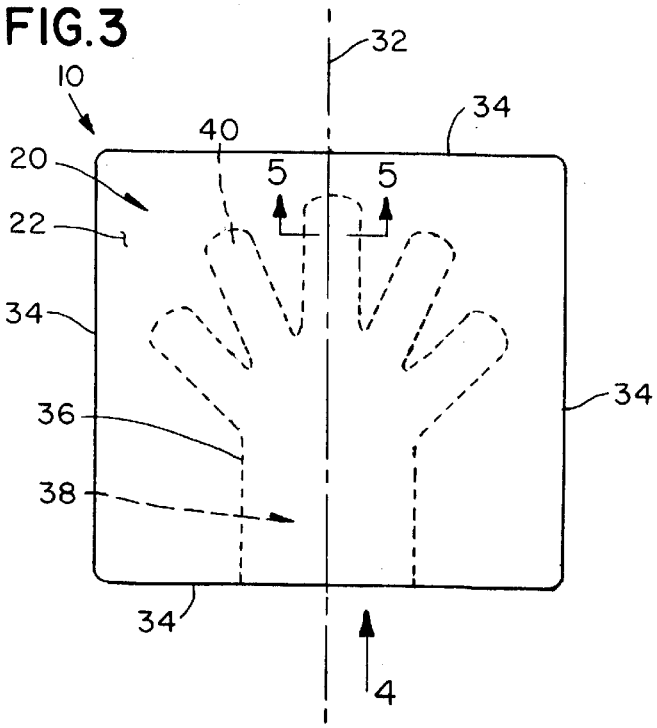
FIG. 3 is an enlarged diagrammatic top plan view of the present invention.
Figure 5:
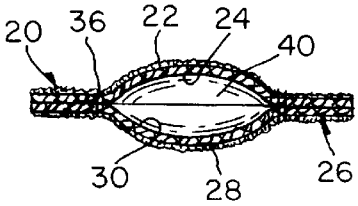
FIG. 5 is an enlarged cross sectional view taken on line 5—5 in FIG. 3.
Figure 4:
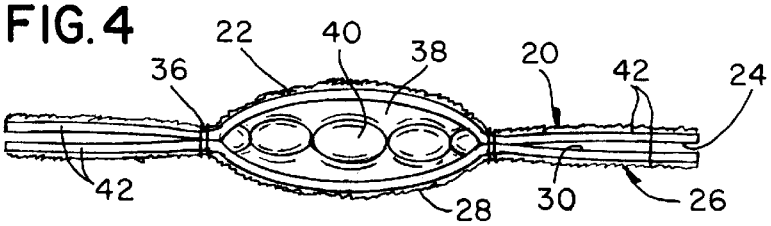
FIG. 4 is an enlarged cross sectional view taken on line 4—4 in FIG. 3.

The configuration of the towel mitt for washing 10 can best be seen in FIGS. 3–5, and as such will be discussed with reference thereto.

The towel mitt for washing 10 comprises a first layer of material 20 that is generally rectangular-shaped and has an outer face 22 of pile and an opposing inner face 24 of a more abrasive texture.

The towel mitt for washing 10 further comprises a second layer of material 26 that is substantially similar to the first layer of material 20 and has an outer face 28 of pile and an opposing inner face 30 of a more abrasive texture.

The first layer of material 20 is juxtaposed on the second layer of material 26 and forms therewith four common edges 34 and a longitudinal centerline 32 with a length, and with the opposing inner face 24 of the first layer of material 20 opposing the opposing inner face 30 of the second layer of material 26, and with the outer face 22 of the first layer of material 20 and the outer face 28 of the second layer of material 26 being exposed.

The first layer of material 20 is maintained juxtaposed on the second layer of material 26 by specifically configured stitching 36 which forms a hand receiving pocket 38 for receiving the hand 12 of the user 14 and which is symmetrical relative to the longitudinal centerline 32 so as to allow the towel mitt for washing 10 to be used on either hand without discomfort, with the opposing inner face 24 of the first layer of material 20 and the opposing inner face 30 of the second layer of material 26 increasing friction for assisting in maintaining the hand 12 of the user 14 in the towel mitt for washing 10 as a result of their abrasiveness.

The specifically configured stitching 36 originates from one common edge of the four common edges 34, equally spaced from both sides of the longitudinal centerline 32, and extends therefrom substantially parallel to, and approximately half the length of, the longitudinal centerline 32, where it then extends radially outwardly to form five finger receiving pockets 40 for receiving the five fingers of the hand 12 of the user 14, with the first and second layers of material 20 and 26 outwardly from the specifically configured stitching 36 being free of each other and forming flaps 42 so as to allow the opposing inner face 24 of the first layer of material 20 and the opposing inner face 30 of the second layer of material 26 to be flipped over and exposed and utilized for washing areas requiring more abrasiveness than afforded by the pile of the outer face 22 of the first layer of material 20 and the outer face 28 of the second layer of material 26.

It will be understood that each of the elements described above, or two or more together, may also find a useful application in other types of constructions differing from the types described above.

While the invention has been illustrated and described as embodied in a towel mitt for washing, however, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A towel mitt for washing, comprising:

a) a first layer of material; and b) a second layer of material juxtaposed on said first layer of material and forming therewith a hand receiving pocket for receiving a hand of a user; said first layer of material forming with said second layer of material four common edges and a longitudinal centerline with a length; said first layer of material being maintained juxtaposed on said second layer of material by specifically configured stitching; said specifically configured stitching originating from one common edge of said four common edges, equally spaced from both sides of said longitudinal centerline, and extending therefrom substantially parallel to, and approximately half said length of, said longitudinal centerline, where it then extends radially outwardly to form five finger receiving pockets for receiving the five fingers of the hand of the user.

2. The mitt as defined in claim 1, wherein said first layer of material is generally rectangular-shaped and has an outer face and an opposing inner face.

3. The mitt as defined in claim 2, wherein said outer face of said first layer of material is pile.

4. The mitt as defined in claim 3, wherein said opposing inner face of said first layer of material is more abrasive than said pile of said outer face of said first layer of material.

5. The mitt as defined in claim 4, wherein said second layer of material is generally rectangular-shaped and has an outer face and an opposing inner face.

6. The mitt as defined in claim 5, wherein said outer face said second layer of material is pile.

7. The mitt as defined in claim 6, wherein said opposing inner face of said second layer of material is more abrasive than said pile of said outer face of said second layer of material so as to increase friction for assisting in maintaining the hand of the user in said towel mitt, as a result of their abrasiveness.

8. The mitt as defined in claim 5, wherein said opposing inner face of said first layer of material opposes said opposing inner face of said second layer of material and said outer face of said first layer of material and said outer face of said second layer of material are exposed.

9. The mitt as defined in claim 1, wherein said specifically configured stitching forms said hand receiving pocket which is symmetrical relative to said longitudinal centerline so as to allow said towel mitt to be used on either hand without discomfort.

10. The mitt as defined in claim 1, wherein said first and second layers of material outwardly from said specifically configured stitching are free of each other and form flaps so as to allow said opposing inner face of said first layer of material and said opposing inner face of said second layer of material to be flipped over and exposed and utilized for washing areas requiring more abrasiveness than afforded by said pile of said outer face of said first layer of material and said outer face of said second layer material.

* * * * *